US005529608A

United States Patent [19]

Jonelis

[11] Patent Number: 5,529,608

[45] Date of Patent: Jun. 25, 1996

[54] SPACER ASSEMBLY FOR USE IN ELECTROSTATIC PRECIPITATOR

[76] Inventor: John A Jonelis, 304 Lancaster Dr., Crystal Lake, Ill. 60014

[21] Appl. No.: 732,956

[22] Filed: May 13, 1985

[51] Int. Cl.[6] ..... B03C 3/08

[52] U.S. Cl. ..... 95/57; 95/78; 96/60; 96/86; 96/87

[58] Field of Search ..... 55/129, 130, 137, 55/140–143, 145, 154, 440; 206/504, 821, 501, 499; 96/62, 65, 75, 76, 83–87, 98–100, 60; 95/57, 78, 79

[56] References Cited

U.S. PATENT DOCUMENTS

| | | | |
|---|---|---|---|
| 1,343,482 | 6/1920 | Schmidt et al. | 55/129 X |
| 1,600,496 | 9/1926 | Weiskopf | 55/140 X |
| 1,838,754 | 12/1931 | Frame | 206/821 X |
| 2,411,864 | 12/1946 | Birkin | 206/501 X |
| 2,603,361 | 7/1952 | James | 206/821 X |
| 4,007,023 | 2/1977 | Batza et al. | 55/143 X |
| 4,033,464 | 7/1977 | Carr | 206/516 |
| 4,647,296 | 3/1987 | Tuck | 96/87 |

FOREIGN PATENT DOCUMENTS

| | | | |
|---|---|---|---|
| 1192087 | 10/1959 | France | 206/821 |
| 1099342 | 1/1968 | United Kingdom | 55/140 |

*Primary Examiner*—Richard L. Chiesa
*Attorney, Agent, or Firm*—Anthony S. Zummer

[57] ABSTRACT

The present invention relates to an improved spacer assembly for use in an electrostatic precipitator. The electrostatic precipitator collects solid particles carried by a flue gas from a source of combustion. The precipitator includes a plurality of spaced parallel plates for collecting the above mentioned particles by electrostatic attraction of the particles to the plates. Each of the plates has a plurality of stiffeners extending outward from the respective plate. Each stiffener is opposite a like stiffener on the opposed plate. A plurality of spacer assemblies is positioned between opposed plates to hold the plates in a flat attitude and to maintain adjacent surfaces of opposed plates equidistantly spaced from one another. Each of the spacer assemblies includes a spacer having opposite ends abutting a pair of opposed parallel plates adjacent to the respective stiffeners of the plates. An upright is connected to the spacer. A second spacer assembly is connected to the first mentioned spacer assembly and is locked thereto. The second spacer assembly includes a spacer extending between the parallel plates. Several spacer assemblies are thus locked together resulting in a plurality of spacers extending between parallel plates adjacent to the stiffeners of the plate.

37 Claims, 8 Drawing Sheets

FIG. 5
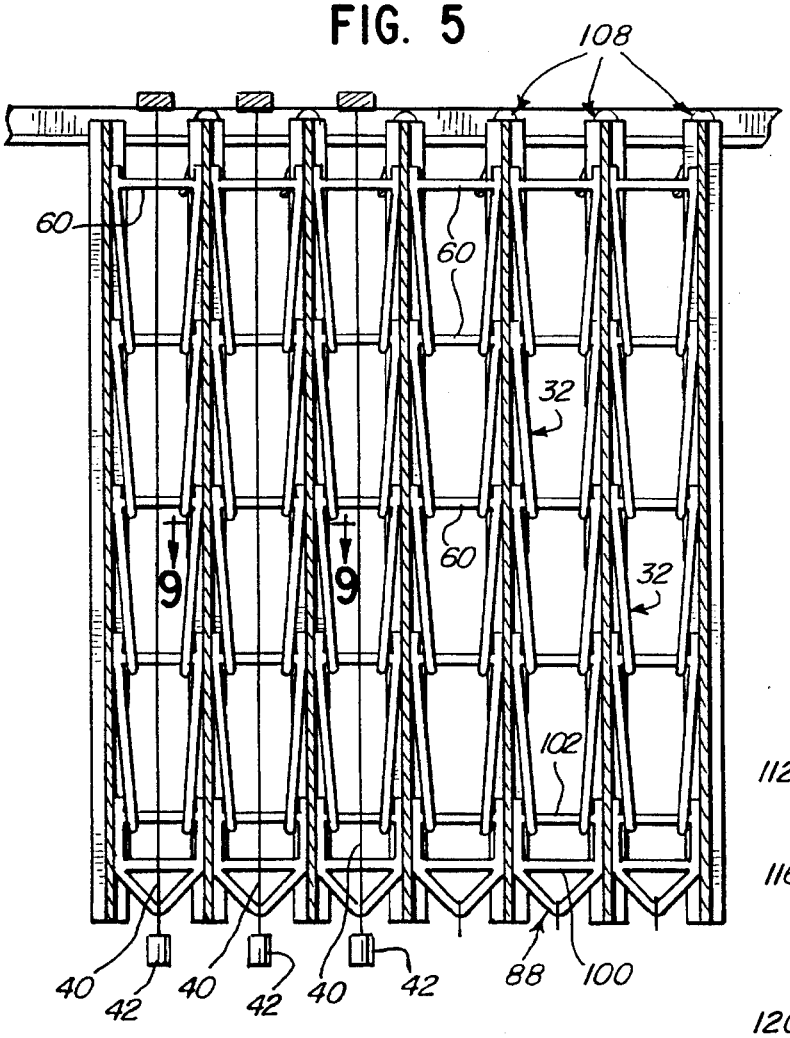
FIG. 6
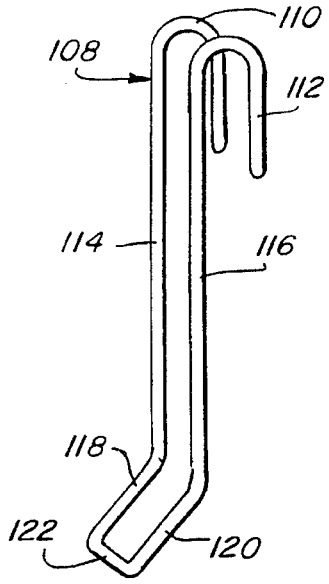
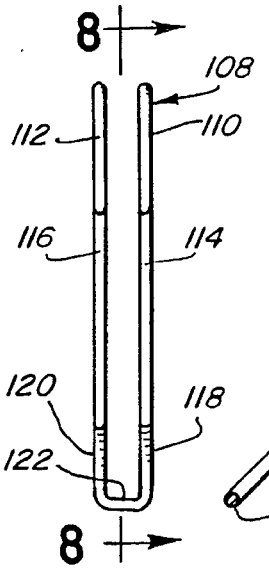
FIG. 7
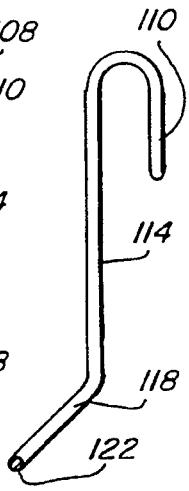
FIG. 8
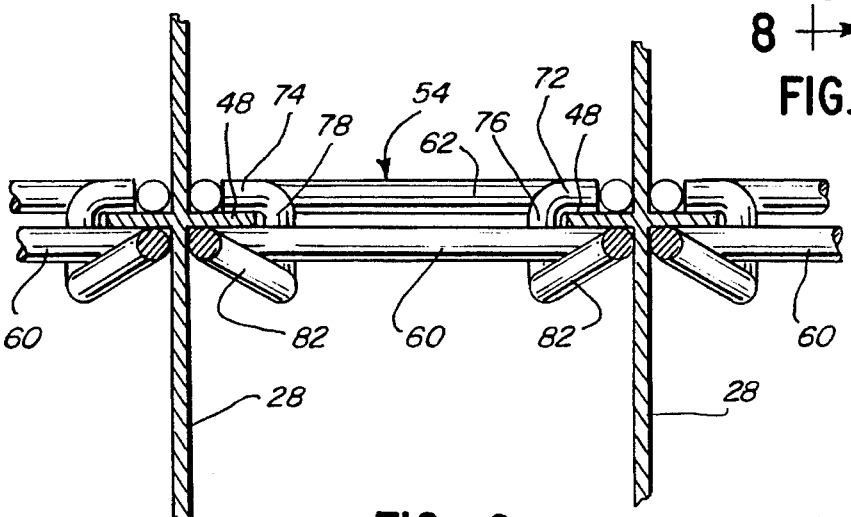
FIG. 9

SPACER ASSEMBLY FOR USE IN ELECTROSTATIC PRECIPITATOR

BACKGROUND OF THE INVENTION

A commonly accepted practice of removing solid particles from a flue gas includes the utilization of an electrostatic precipitator to hold the solid particles without inhibiting the flow of the flue gas. Typically, an electrostatic precipitator is positioned in the flue between the outlet of a boiler and a smokestack.

The ordinary construction of an electrostatic precipitator includes a plurality of large, flat, metal plates which are spaced from each other. The metal plates may have a height of up to 30 feet or more, and a width of up to 10 feet or more. It is to be appreciated that the specific size of the plates in a given precipitator is dependent upon the particular precipitator construction for a given application. Ideally, the flat plates are equidistantly spaced from each other. A second plurality of elongated electrodes is positioned among the plates. The electrodes are positioned between each pair of adjacent plates. Ideally, the elongated electrodes are equidistantly spaced from the adjacent plates.

The uniform spacing of the elongated electrodes from the plates is necessary to have a uniform electrostatic charge between the elongated electrodes and the plates. A uniform electrostatic charge generates uniform collection of solid particles on the plates. Typically, the solid particles are removed from the plates by rapping the plates to vibrate the plates and, thereby, cause the collected solid particles to drop off the plates in clusters into collectors under the plates.

The flue gas which enters the electrostatic precipitator is hot. Commonly, additional heat enters the precipitator in the form of fires caused by problems in the operation of the boiler. Exposure of the plates to excessive heat as well as other factors can cause the plates to warp or buckle. The warping or buckling of the plates destroys the uniform spacing between adjacent surfaces of adjacent plates and uniform spacing between each of the elongated electrodes and the respective adjacent plates. Thereby, the effectiveness of the precipitator in removing solid particles from a flue gas is reduced so that the precipitator has a lower capacity. Consequently, the capacity of the boiler, which produces the flue gas, must also be lowered to comply with emissions regulations. In the case of a power generation unit, as the capacity of the boiler is reduced, the capacity of a power generating system connected to the boiler is also reduced. In order to maintain an electrostatic precipitator fully effective, it is desirable to maintain the spaced plates of the precipitator in an equidistantly spaced relationship to each other and to the electrodes.

The concept of providing spacers to hold electrostatic precipitator plates apart a uniform distance is known. U.S. Pat. No. 4,007,023, issued Feb. 8, 1977, to Batza et al, entitled, "Electrostatic Precipitator With Collector-electrode Spacers", discloses a construction wherein spacers are hingedly mounted on a pivot. U.S. Pat. No. 4,478,614, issued to John A. Jonelis on Oct. 23, 1984, entitled, "Electrostatic Precipitator Construction Having Spacers" discloses a construction wherein a plurality of individual spacers are positioned between electrostatic precipitator plates. These spacers are mounted directly to the plates or installed by use of a long probe. U.S. Pat. No. 4,479,813, issued to John A. Jonelis on Oct. 30, 1984, entitled, "Electrostatic Precipitator Construction Having Ladder Bar Spacers" teaches a construction wherein a plurality of spacer devices are positioned between electrostatic precipitator plates, each device consisting of a plurality of spacers. These spacers are mounted directly, or loaded from the top or bottom of the plates as practical. It is a principal object of this invention to provide a spacer assembly for use in an electrostatic precipitator wherein the spacer assembly may be interlocked with other spacer assemblies. In this way, more than one spacer assembly is connected together thus forming one construction made up of a plurality of spacers, and connected to the stiffeners of the plates. Spacer assemblies are locked together during installation within the precipitator, thus allowing the construction to be loaded from the top or bottom of the precipitator plates with greater facility than the previous construction. The installed construction can be more readily removed than previous constructions. In addition, the weight of the installed construction aids in the straightening of the collector plates, and the installed construction can be held in tension if required to aid in straightening the plates. The present assembly can be made to add structural strength along the length of the collector plate.

SUMMARY OF THE INVENTION

The subject matter of this invention is a spacer assembly for use in an electrostatic precipitator. The electrostatic precipitator collects solid particles carried by a flue gas from a source of combustion. The precipitator includes a plurality of spaced parallel plates for collecting solid particles by electrostatic attraction of the particles to the plates. Each of the plates has a plurality of stiffeners extending outward from each plate toward an opposite stiffener on an opposite plate. A plurality of elongated electrodes is mounted between adjacent plates. Each of the elongated electrodes is parallel to the other electrodes and to the plates. The elongated electrodes are equidistantly spaced between the plates. A plurality of spacer assemblies is positioned between adjacent plates to hold the plates in a flat attitude and to maintain adjacent surfaces of adjacent plates at a selected distance from one another. Each of the spacer assemblies includes a spacer having opposite ends connected to opposed parallel plates at the respective stiffeners of the plates. An upright is connected to each spacer for interface with another spacer assembly. The spacer assemblies are interlocked with one of the spacer assemblies being connected to another spacer assembly.

BRIEF DESCRIPTION OF THE DRAWINGS

FIG. 5 is an elevational view of a plurality of plates showing the positioning of spacer assemblies between the plates;

FIG. 6 is a perspective view of a top support used with the subject spacer assembly;

FIG. 7 is an end elevational view of the top support shown in FIG. 6;

FIG. 8 is a partial cross sectional view taken on line 8—8 of FIG. 7;

FIG. 9 is an enlarged cross sectional view taken on line 9—9 of FIG. 5 showing the interrelationship of a pair of spacer assemblies with a pair of opposed stiffeners;

DESCRIPTION OF THE PREFERRED EMBODIMENT

Figure 1:
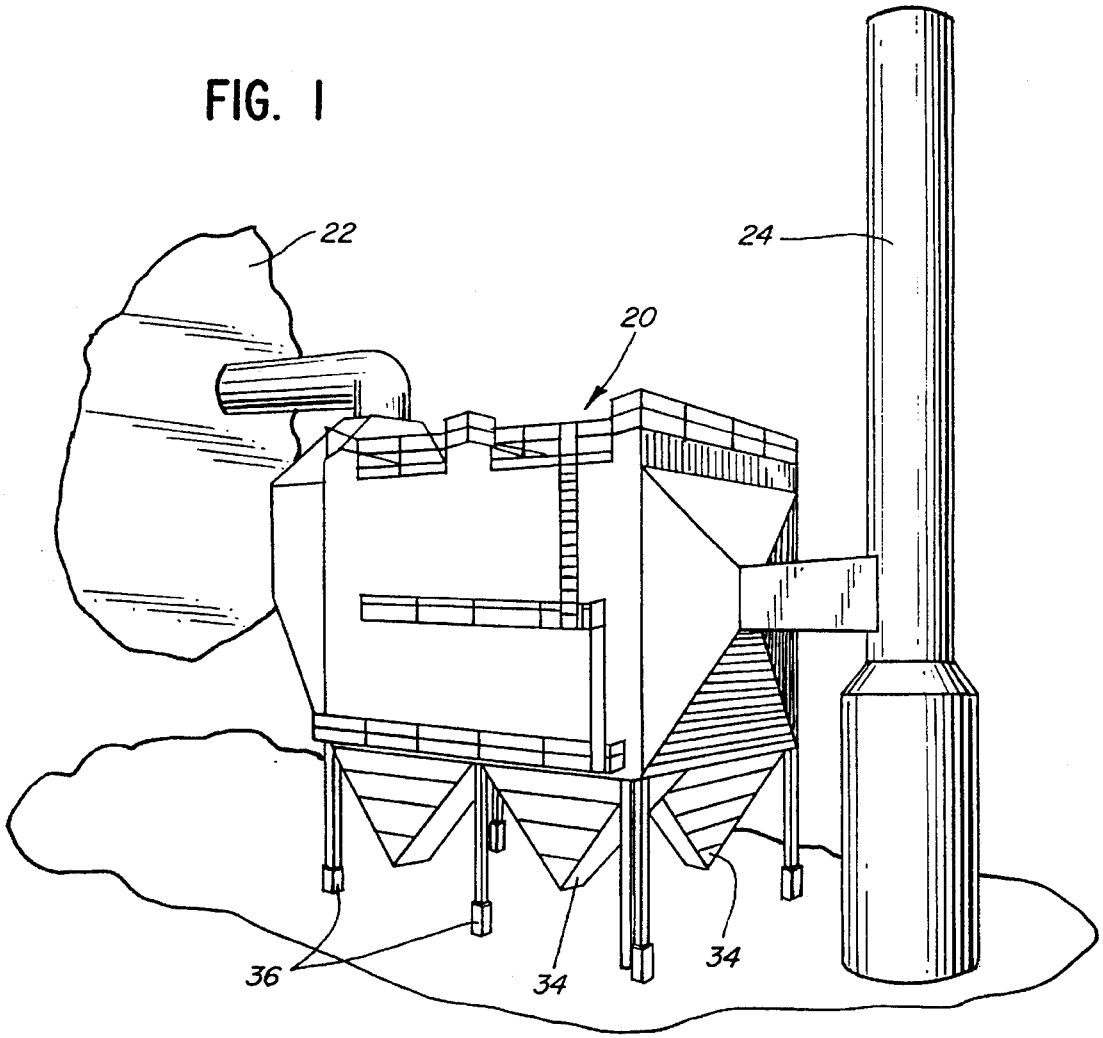
FIG. 1 is a perspective view of an electrostatic precipitator including the herein disclosed invention positioned between a conventional boiler and a conventional smokestack.
Figure 2:
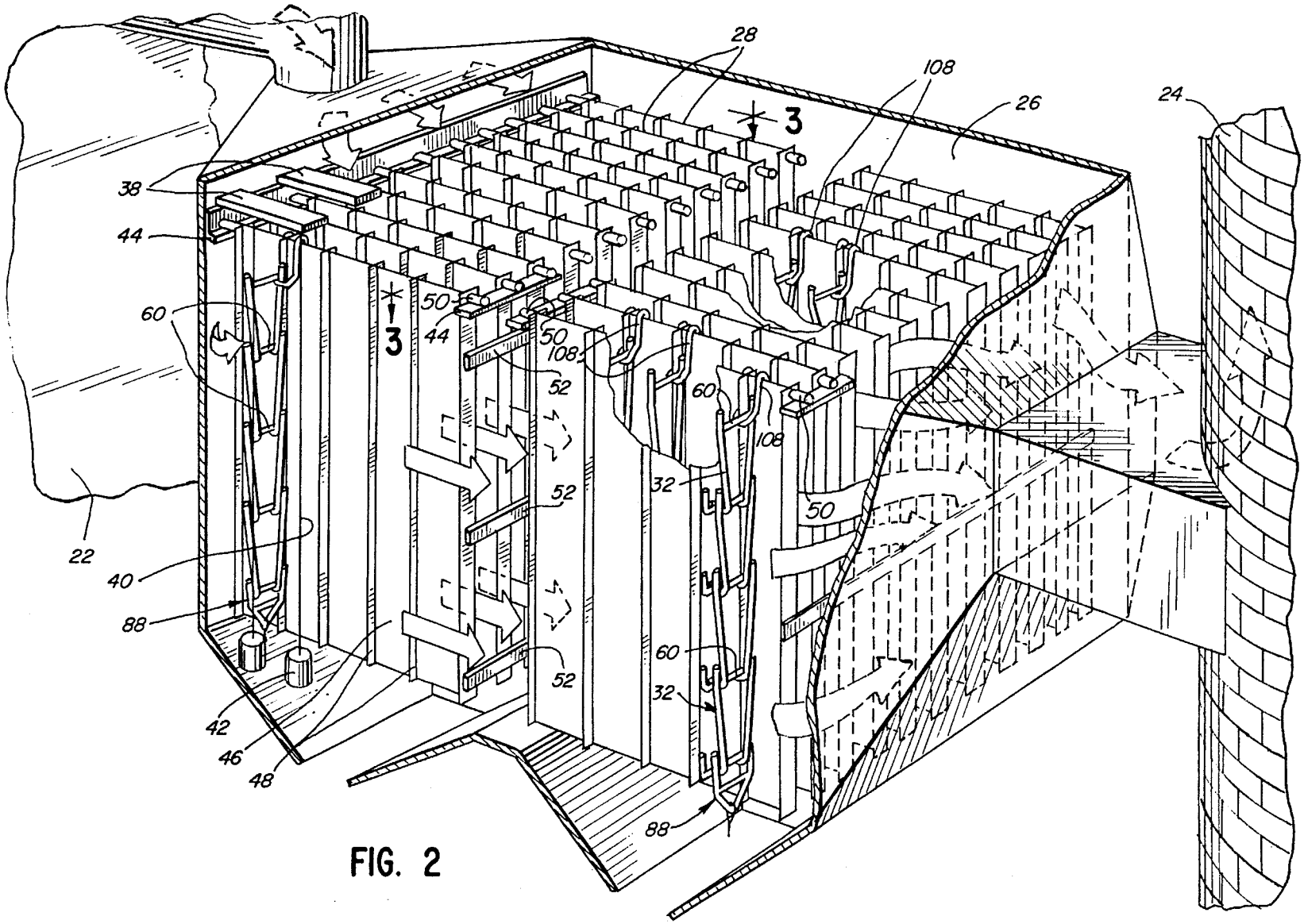
FIG. 2 is an enlarged fragmentary broken-away perspective view of the electrostatic precipitator shown in FIG. 1 showing a plurality of plates and spacer assemblies mounted between certain of the plates to maintain the plates in a uniform spaced relationship.
Figure 4:
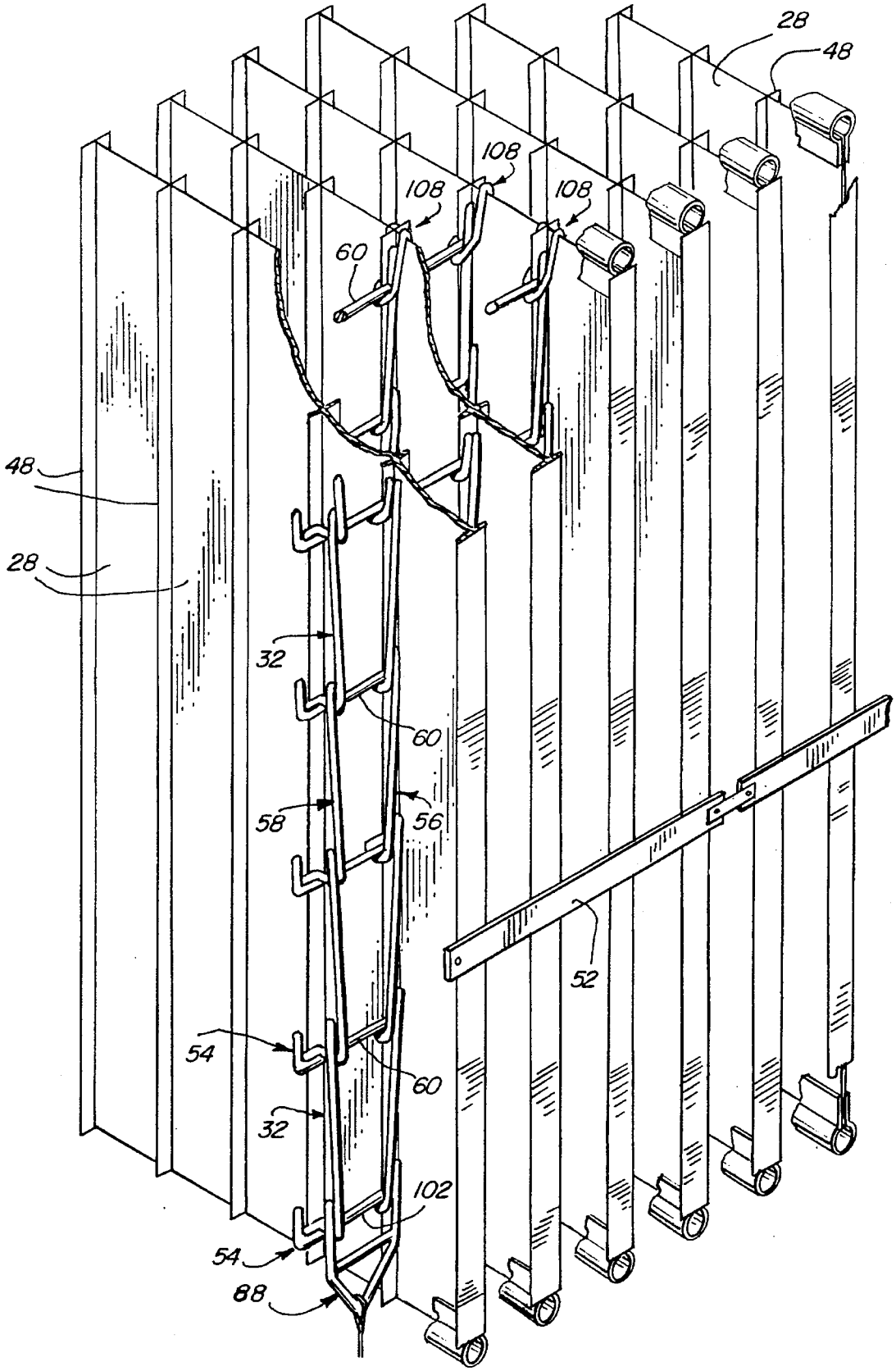
FIG. 4 is a fragmentary enlarged perspective view of a plurality of plates of the electrostatic precipitator of FIG. 1 showing spacer assemblies mounted between certain adjacent plates.
Figure 10:
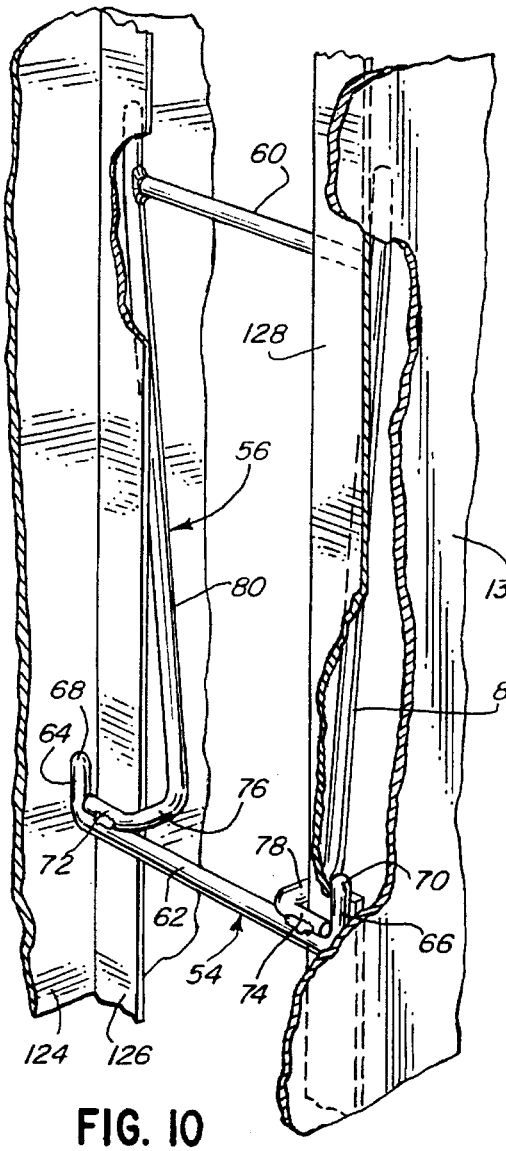
FIG. 10 is an enlarged perspective view showing a single spacer assembly mounted between a pair of opposed electrostatic plates and showing the interrelationship of the spacer assembly with the stiffeners of the plates.

Referring now to the drawings, and more particularly to FIG. 1, an electrostatic precipitator including the present invention is generally indicated by numeral 20. The precipitator is connected to a flue between a conventional furnace or boiler 22 and a conventional smokestack 24. As may be seen in FIG. 2, the precipitator includes a housing 26, with a plurality of identical spaced flat metal plates 28 mounted in the housing. A second plurality of elongated electrodes 30 is positioned between the plates. A third plurality of spacer assemblies 32 is mounted between opposed parallel plates 28 to maintain the plates in a uniform spaced relationship and to flatten those plates which may tend to warp or buckle.

Electrodes 30 are connected to a high voltage electrical source which is not shown herein. As is well known in the art, an electrostatic charge is emitted by the electrodes and is received by solid particles carried by the flue gas from the boiler as it passes through the precipitator. The charged particles are then attracted to the plates 28 which are oppositely charged. The cleansed flue gas flows to smokestack 24 and is discharged.

The construction of the electrostatic precipitator is conventional in that the electrostatic precipitator housing 26 has its inlet connected to ductwork from boiler 22. The housing is closed and has an outlet connected to ductwork leading to smokestack 24. The bottom of housing 26 includes a plurality of collector hoppers 34 which are adapted to receive solid particles which are collected on the plates. Housing 26 includes a plurality of legs 36 to support the precipitator.

A high tension frame 38 is mounted in housing 26. Frame 38 is conventional in its construction and is connected to the source of electrostatic charge. Elongated electrodes 30 are mounted on frame 38. Each of the electrodes 30 is a single metallic electrically conductive wire 40 with a weight 42 attached to the end of the wire to hold the wire taut and perpendicular to the horizontal. Since each of the electrodes 30 is held taut by its respective weight, all of the electrodes are parallel to each other. When desirable, rigid electrodes constructed of pipe or other materials may be used in lieu of wires and weights.

The precipitator includes a plurality of plate support rails 44 mounted within housing 26. Plates 28 are mounted between adjacent rails 44. Each plate 28 includes a metallic electrically conductive collector surface 46 with a plurality of stiffeners 48 formed in the plate to make the plate rigid. The stiffeners of each plate are opposite to the stiffeners of the adjacent plate. A pair of ears 50 is fixed to the upper portion of each of the collector surfaces to provide a means for supporting the respective plate on rails 44. Other methods of attachment are provided when required. When desirable, a plurality of side spacer bars 52 is secured to the ends of the plate to hold the ends of the plates in a selected spatial relationship relative to each other.

Figure 3:
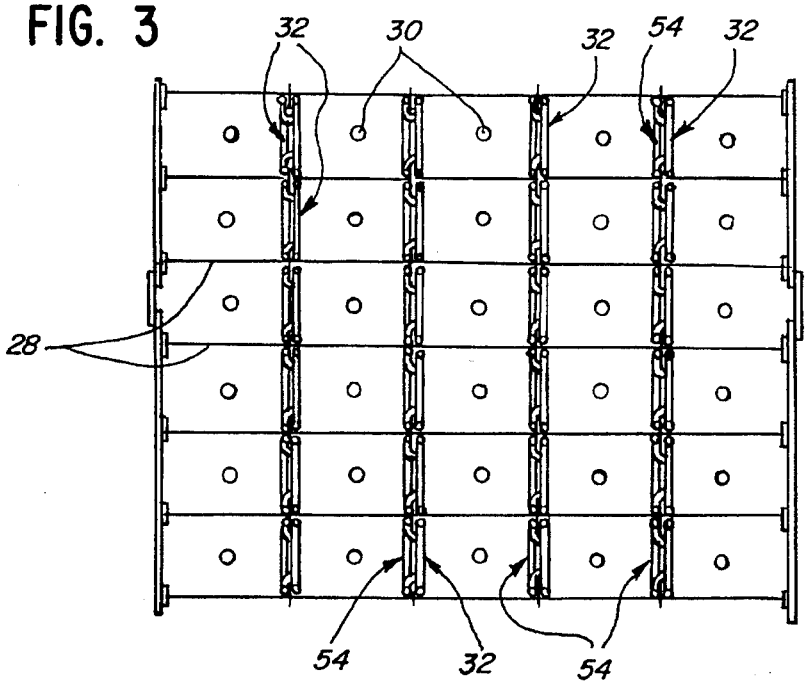
FIG. 3 is a plan view of a portion of the precipitator of FIG. 2 taken on line 3—3 of FIG. 2 showing the relative positioning of the plates, elongated electrodes and spacer assemblies between adjacent plates.

As may be seen in FIG. 3, the plates are regularly spaced from each other and each of the electrodes is positioned between a pair of adjacent plates. Ideally, the electrodes are equidistantly spaced between the plates so that there is regular spacing between the electrodes and the plates.

In a correctly constructed new installation, the plates and electrodes are equidistantly and regularly spaced as shown in FIG. 3. Due to improper original manufacture or construction, or after a prolonged usage of the precipitator, the plates tend to warp and buckle. The resulting disperity in the distance between adjacent plates and electrodes reduces the effectiveness of the precipitator. In order to bring the precipitator back to its original effectiveness, and in some instances provide an improved capacity, or in order to prevent such warping and buckling, spacer assemblies 32 are positioned between adjacent surfaces of adjacent plates to straighten the plates and to equalize the distance of adjacent surfaces and adjacent plates.

Figure 11:
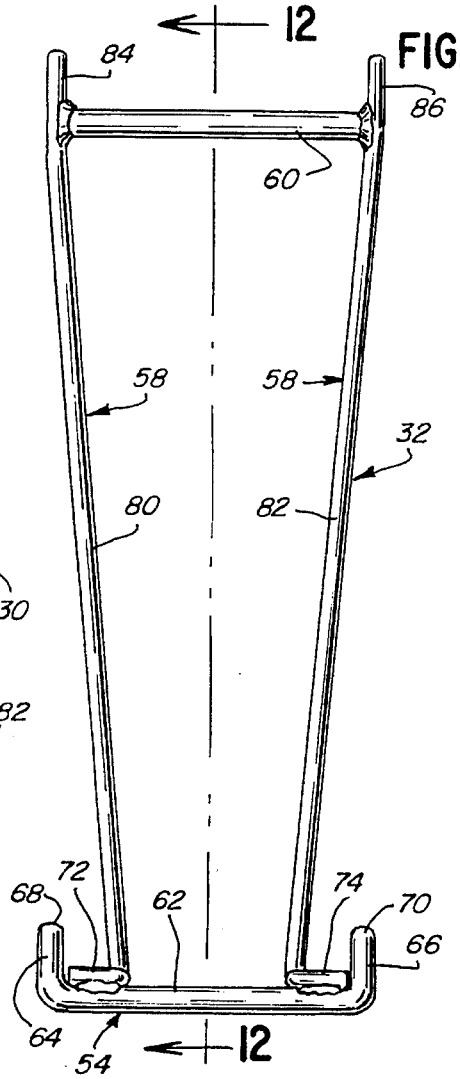
FIG. 11 is a front elevational view of the spacer assembly of FIG. 10.
Figure 12:
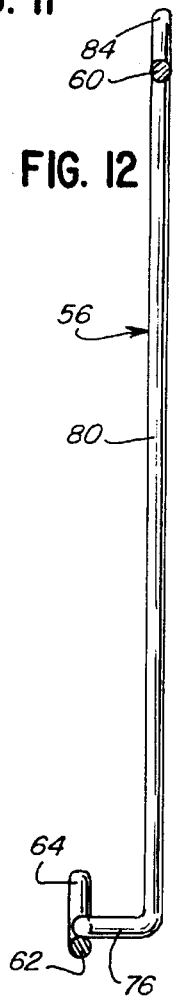
FIG. 12 is a partial cross sectional view taken on line 12—12 of FIG. 11.

Referring now to FIG. 11, spacer assembly 32 is shown therein. Spacer assembly 32 generally includes a spacer 54 with a pair of uprights 56 and 58 fixed to the spacer and a second spacer, hereinafter referred to as a strut 60, fixed to the uprights. Each of the uprights is a metal rod as is the strut.

Spacer 54 includes an elongated bar 62. The bar has a stop 64 formed integral with one end and a stop 66 formed integral with the other end. Each of the stops 64 and 66 is substantially perpendicular to the length of bar 62. Stops 64 and 66 have rounded ends 68 and 70, respectively. Stops 64 and 66 with bar 62 define a first plane. The stops are particularly adapted for engagement with opposed electrostatic plates, as will be described hereinafter.

Uprights 56 and 58 includes ears 72 and 74, respectively. Ears 72 and 74 are welded to bar 62 so that the ears are in line and parallel to the length of the bar. Uprights 56 and 58 include linking arms 76 and 78, respectively, which are formed integral with ears 72 and 74, respectively. The linking arms are perpendicular to respective ears 72 and 74. Taper posts 80 and 82 are formed integral with linking arms 76 and 78, respectively. The taper posts are substantially perpendicular to the respective linking arms. The taper posts 80 and 82 define a second plane which is substantially parallel to the first plane. The taper posts 80 and 82 flare outward from each other and terminate upward in upright bars 84 and 86, respectively, which bars 84 and 86 are formed integral with the ends of taper posts 80 and 82. The upright bars 84 and 86 are parallel to each other. Strut 60 is welded to upright bars 84 and 86 and is parallel to bar 62 of the spacer. It is evident that the spacer assembly is in effect a unitary assembly.

Figure 13:
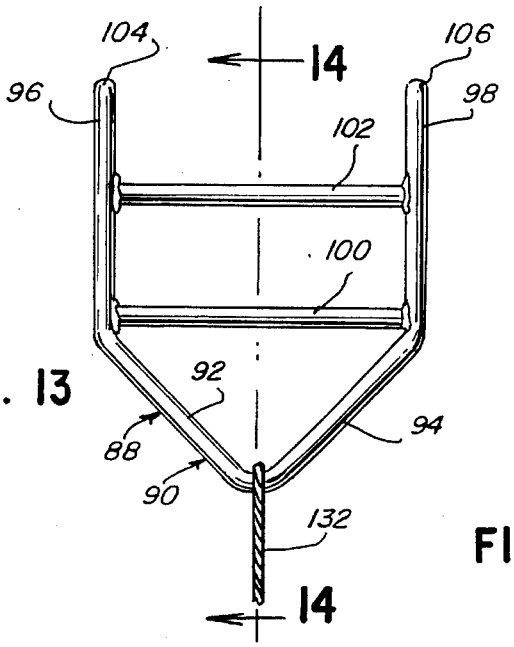
FIG. 13 is a front elevational view of a bail used in moving a spacer assembly along a pair of stiffeners.
Figure 14:
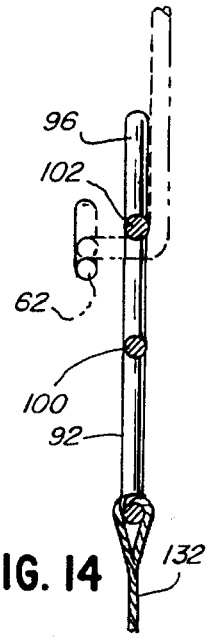
FIG. 14 is a partial cross sectional view taken on line 14—14 of FIG. 13 showing in phantom view the positioning of a spacer and a portion of an upright of a spacer assembly in relation to the bail.

A bail 88, which may be best seen in FIGS. 13 and 14, is an alternate spacer assembly used herein to provide a means for securing a device to a spacer assembly to move the spacer assembly between a pair of opposite electrostatic plates, as will be described hereinafter. The bail is constructed of metal rod. Bail 88 includes a pull 90. Pull 90 includes a pair of integral bars 92 and 94 which generally form a "V". Parallel shafts 96 and 98 are formed integral with the ends of bars 92 and 94, respectively, to complete the pull. A spacer, hereinafter referred to as a crosstie 100 is welded to shafts 96 and 98 adjacent to bars 92 and 94, respectively. A second spacer, hereinafter referred to as a rung 102 is also welded to shafts 96 and 98 adjacent to ends 104 and 106 of shafts 96 and 98, respectively. The rung 102 is parallel to crosstie 100 and is spaced away from the crosstie so that a spacer 54 may be inserted through the space between the rung and the crosstie to allow linking arms 76 and 78 to engage the rung and thereby lock the bail to a spacer assembly.

A top support 108 which is best seen in FIGS. 6, 7 and 8, provides a convenient means for supporting the spacer assembly. The top support includes a pair of identical hooks 110 and 112. The hooks are spaced from each other and are parallel to each other. Hooks 110 and 112 include hook shanks 114 and 116, respectively, which shanks are spaced from each other and are parallel to each other. Offset arms 118 and 120 are formed integral with shanks 114 and 116, respectively. The offset arms are also parallel to each other. A connector 122 has one end formed integral with offset arm 118 and the other end formed integral with offset arm 120. The top support is particularly adapted for receiving strut 60 in engagement with connector 122. Hooks 110 and 112 are placed into engagement with the precipitator plate and thereby hold the spacer assembly in a vertical direction with relation to the stiffeners.

Figure 15:
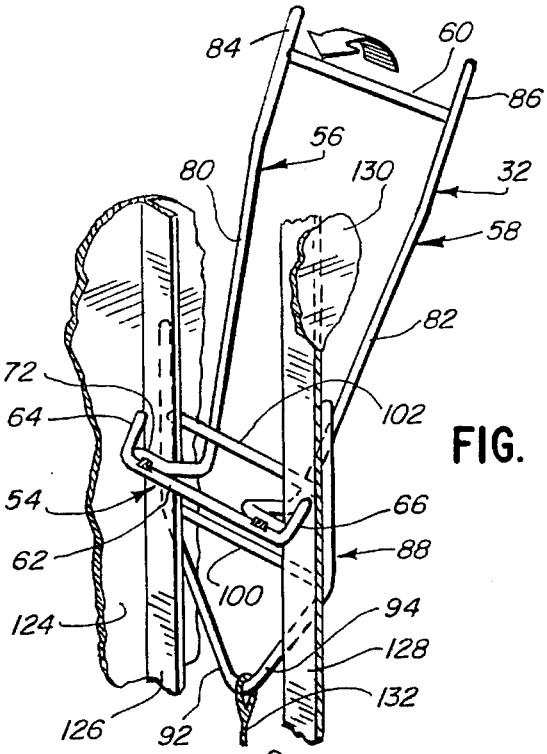
FIG. 15 is a fragmentary view of a pair of stiffeners of opposed electrostatic precipitator plates showing a bail in position and the positioning of a spacer assembly between the stiffeners and into a locking relationship with the bail. This view of the spacer assembly shows the movement of the spacer assembly toward the stiffeners.
Figure 16:
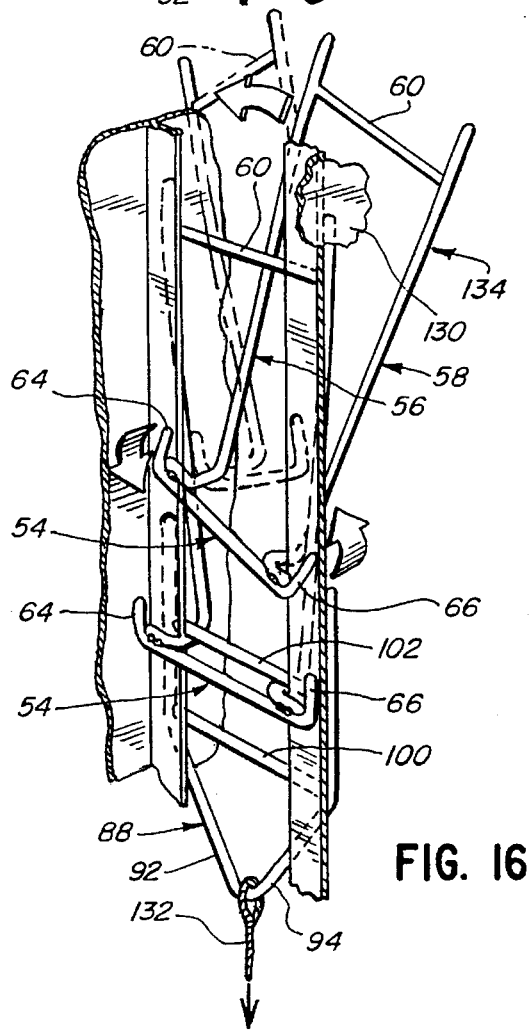
FIG. 16 is a fragmentary perspective view similar to FIG. 15 but showing a second spacer assembly being connected to the spacer assembly shown in FIG. 15. A dotted form shows an initial position of the spacer assembly.
Figure 17:
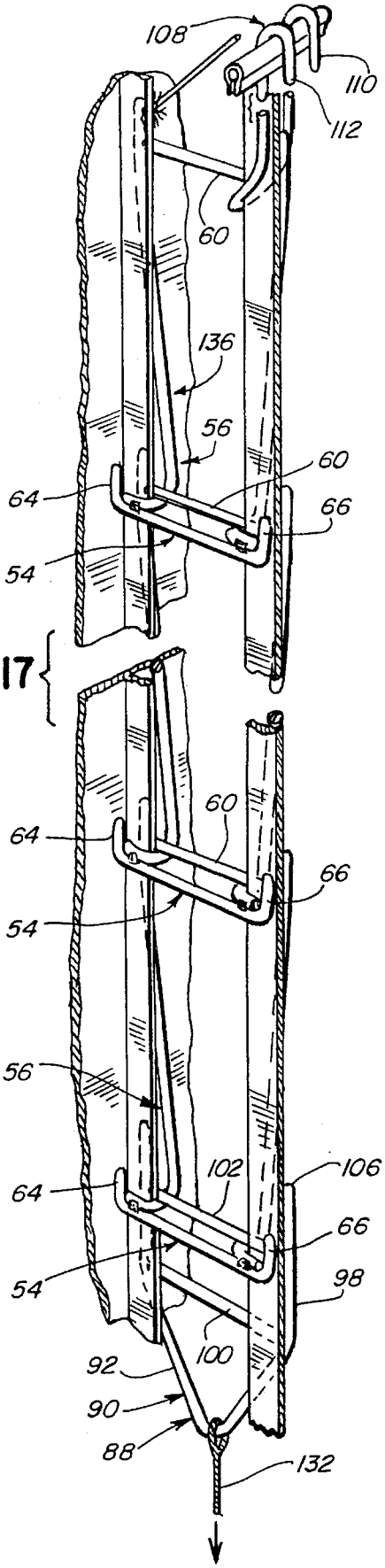
FIG. 17 shows the spacer assembly of FIG. 15 in position connected to the bail along with the spacer assembly of FIG. 16 and a third spacer assembly connected to the second spacer assembly with a top support connected to the uppermost spacer assembly.

Referring now to FIGS. 15, 16 and 17, it may be seen how the instant spacer assemblies are installed between a pair of electrostatic precipitator plates. FIG. 15 shows a portion of one of the plates 28 which is herein identified as plate 124 with a conventional stiffener identified by numeral 126 extending outwardly from the plate. A second conventional stiffener identified by numeral 128 is shown opposite to stiffener 126. The opposing plate for stiffener 128 is identified as plate 130 which plate is parallel and opposed to plate 124. When the plates become warped or buckled, and it is necessary to insert spacer assembly 32, bail 88 is positioned on one side of stiffeners 126 and 128. The bail has a conventional rope 132 secured to pull 90. Any other conventional means of applying a pulling force to the bail may be used instead of a rope. The rope rests in the bottom of the "V". The spacer assembly is positioned adjacent to the bail, and the spacer assembly is tilted slightly so that spacer 54 may be inserted in the opening between crosstie 100 and rung 102. The stops 64 and 66 are placed into engagement with plates 124 and 130 and the uprights 56 and 58 are then tilted upward so that stops 64 and 66 come into engagement with one side of the stiffeners 126 and 128 while the bail is on the opposite side of the stiffeners along with the uprights. Uprights 56 and 58 are complementary to each other and they taper outward from the spacer. Thus, the spacer assembly may be inserted between the stiffeners and through the opening between crosstie 100 and rung 102. A distance between a first plane formed by the stops and elongated bar 62 and a second plane defined by the taper posts 80 and 82 are spaced a distance greater than the thickness of the strut 60 and the stiffeners 126 and 128.

Once spacer assembly 32 is in position, a downward force is applied to rope 132 to pull the spacer assembly downward. A second spacer assembly 134 which is identical in construction to spacer assembly 32 described in detail above, is inserted between the stiffeners 126 and 128 between the uprights. The operation of insertion of spacer 134 is identical to the insertion of spacer 32. Since the spacers are identical in construction, the same numbers are used for the same parts. The spacer assembly 32 is pulled downward until strut 60 of spacer assembly 32 engages the linking arms of spacer assembly 134. It may be appreciated that thus, the spacer assemblies are interlocked. A force is applied to rope 132 to pull the spacer assemblies 32 and 134 downward. A third spacer assembly 136 is positioned between the stiffeners and between the uprights of spacer assembly 134. A force is applied to the rope to pull the spacer assemblies 32, 134 and 136 downward. The spacer assembly 136 is interlocked with spacer assembly 134 and spacer assembly 134 is interlocked with spacer assembly 32. The step is repeated until the desired number of spacers are installed. It is important to note that the spacers are held parallel to each other perpendicular to opposite plates 124 and 130 adjacent to the stiffeners and on one side of the stiffeners. The uprights are held on the opposite side of the stiffeners. The linking arms are positioned between the stiffeners.

Top support 108 is connected to strut 60 of the uppermost spacer assembly 136. The top support is slipped under the strut with hooks on either side of the strut until connector 122 engages strut 60. Hooks 110 and 112 are placed over the edge of the plate so that the weight of the spacer assembly is supported on the edge of the plate. Although only one top support is shown in FIG. 17, it may be appreciated that another top support may be utilized on the other side and in engagement with the other plate. Rather than utilizing the top support to hold up the spacer assemblies, the uppermost spacer assembly may have the upright bars welded to the plates and thereby secure the spacer assemblies into position.

Although the instant embodiment has been shown and described in detail with the spacer assemblies installed starting at the top of the plates, it is readily apparent that in certain instances, it may be more desirable to start the installation from the bottom. This would simply mean a reversal of the direction of movement of the spacer assemblies.

Figure 20:
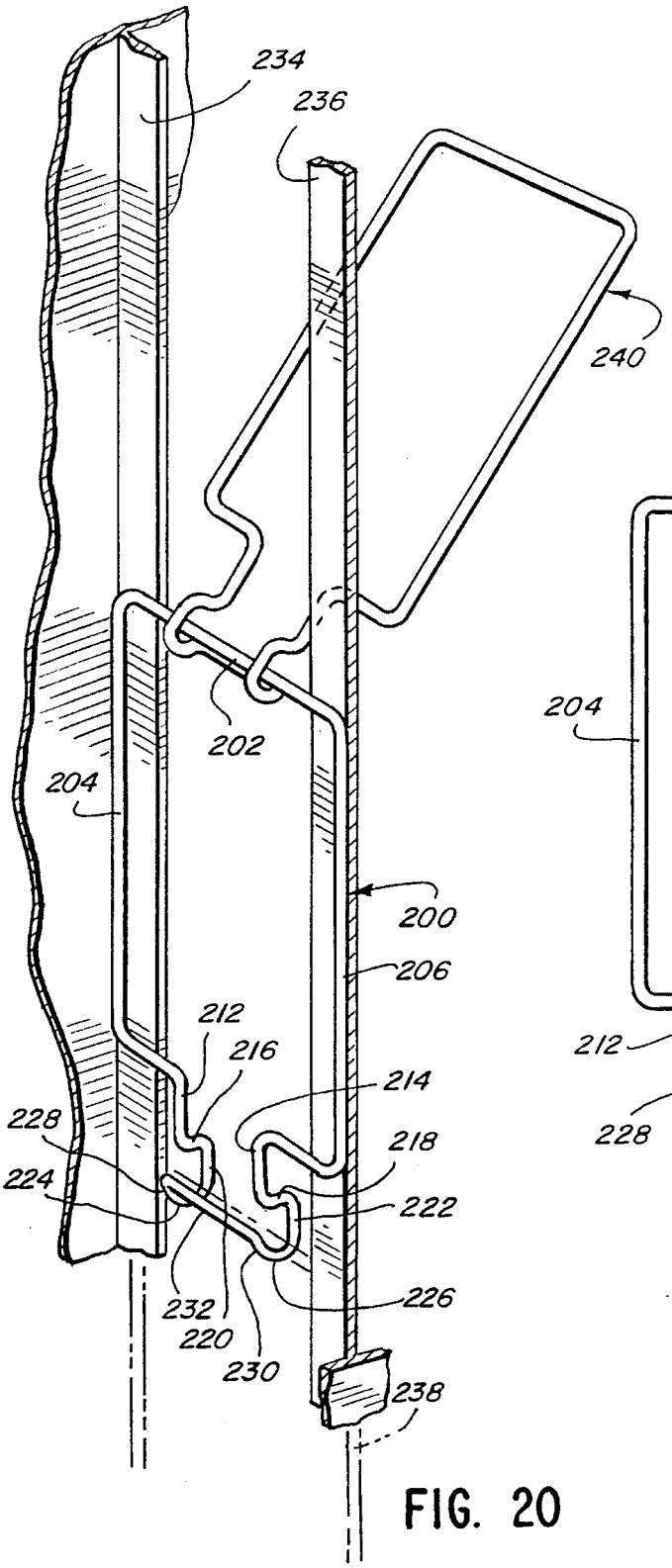
FIG. 20 is a perspective view showing a spacer assembly of FIGS. 18 and 19 positioned on one side of a pair of stiffeners of an electrostatic precipitator, a portion of a second spacer assembly shown in dotted form positioned on the other side of the same pair of stiffeners, and a third spacer assembly connected to the first mentioned spacer assembly and being moved into position on the other side of the stiffeners.
Figure 18:
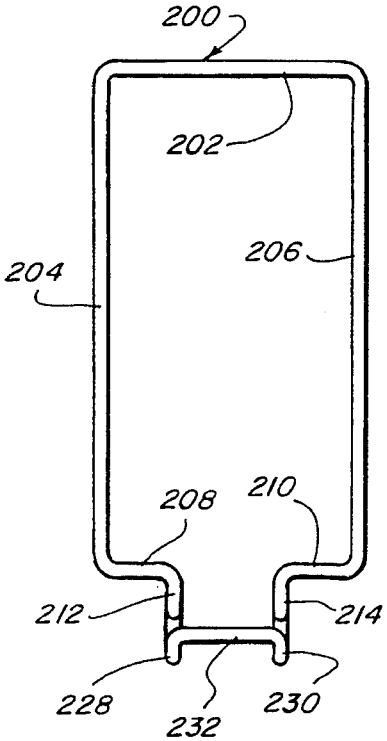
FIG. 18 is a front elevational view of a spacer assembly of a second form embodying the herein disclosed invention.
Figure 19:
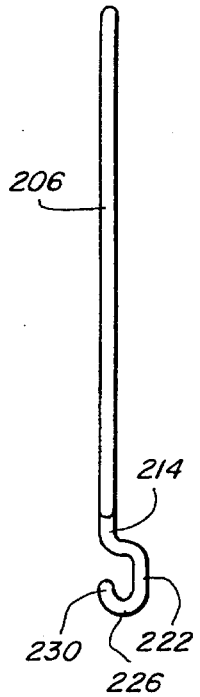
FIG. 19 is a side elevational view of the spacer assembly of FIG. 18.

Referring now to FIGS. 18, 19 and 20, a second form of spacer assembly is shown therein which is identified as spacer assembly 200. Spacer assembly 200 includes a spacer 202 with a pair of uprights 204 and 206 formed integral with opposite ends of the spacer. The uprights 204 and 206 have bars 208 and 210, respectively, formed integral with the lower end of each of the uprights. The bars 208 and 210 have columns 212 and 214, respectively, formed integral with the bars. Columns 212 and 214 have offsets 216 and 218 formed integral therewith. Risers 220 and 222 are formed integral with offsets 216 and 218, respectively. Linking arms 224 and 226 are formed integral with risers 220 and 222. Ears 228 and 230 are formed integral with the linking arms 224 and 226, respectively. The ears 228 and 230 are connected by a cross bar 232 which has opposite ends formed integral with ears 228 and 230. As may be seen in FIG. 19, the arrangement provides a generally hook-like arrangment wherein the linking arms 224 and 226 provide the base of the hook for holding a like spacer assembly slightly offset from the uprights.

As may be seen in FIG. 20, spacer assembly 200 may be loaded between a pair of adjacent plates on opposite sides of a pair of opposed stiffeners 234 and 236. Looking now to FIG. 20, a spacer assembly 238, which is identical to spacer assembly 200, is shown on the far side of stiffeners 234 and 236. As viewed in FIG. 20, spacer assembly 200 is shown in supporting engagement with the spacer assembly 238 and spacer 200 has its uprights 204 and 206 on the other side of the stiffeners from that of spacer assembly 238. A third spacer assembly 240, identical in construction to spacer assembly 200, is shown in an attitude for mounting the spacer assembly between the plates and in engagement with stiffeners 234 and 236. Spacer assembly 240 has its hook-like arrangement in supporting engagement with spacer 202, and the spacer assembly is shown being moved into position on the far side of stiffeners 234 and 236.

Once the spacer assembly 240 is in position, it may be appreciated that the stiffeners 234 and 236 are engaged in opposite sides by the uprights of the spacer assembly so that the uprights frictionally engage the stiffeners. The spacer assemblies are continually pulled down between the stiffeners while additional spacers are added from the top. It may be appreciated that the installation operation may be reversed, that is, the assembly may be pulled upward rather than downward.

Once a sufficient number of spacer assemblies are positioned between adjacent plates, the spacer assembly may be locked into place by welding the uppermost spacer assembly to stiffeners 234 and 236. It may be appreciated that any other means of securing the uppermost spacer assembly in position may be used other than welding.

Referring now to FIGS. 21, 22, 23, and 24, a third form of spacer assembly is shown therein and is identified by numeral 300. Spacer assembly 300 includes a pair of spacers 302 and 304, and a pair of uprights 306 and 308 formed integral with the opposite ends of the spacers. In this application, the spacers 302 and 304 also serve as holding portions. A holding device 310 is used to connect the assembly 300 to another like spacer assembly. The holding device is a hollow cylinder having a generally circular cross section. A gap 312 extends along the length of the holding device. The gap is large enough to allow the device to receive spacer 302 of one assembly 300 and spacer 304 of another identical assembly. The holding device is adapted to be closed, thereby narrowing the gap 312 to lock the two spacers in supportive engagement by using a crimping tool which is not shown.

Figure 24:
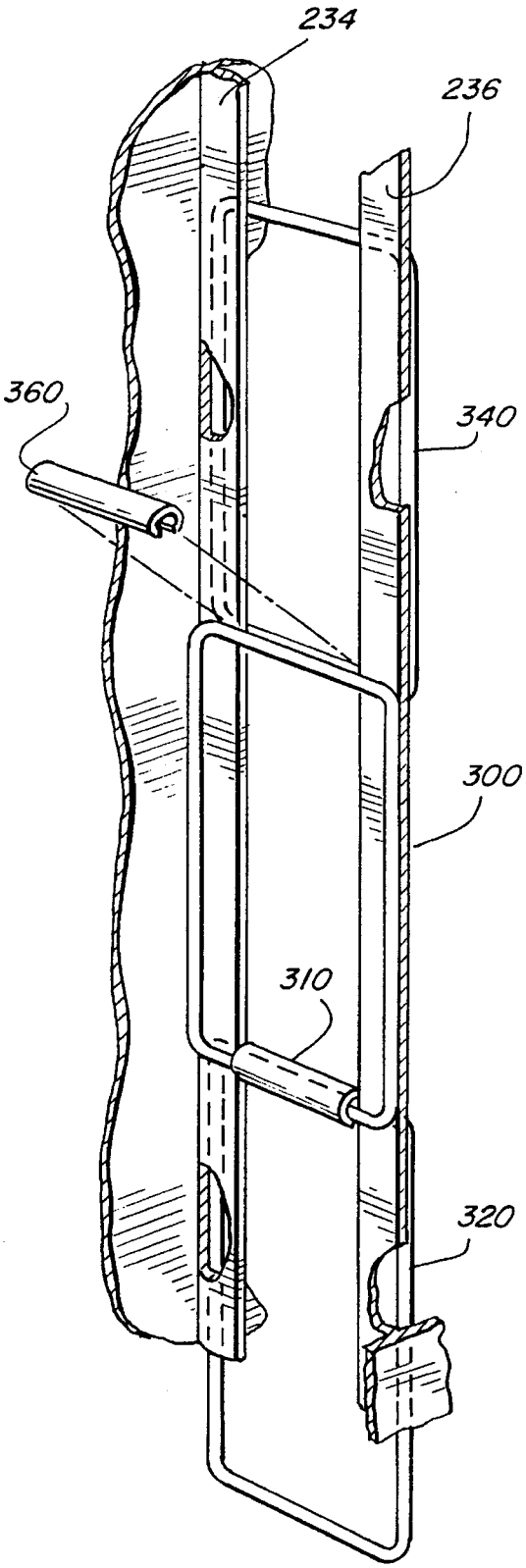
FIG. 24 is a perspective view showing a spacer assembly of FIG. 21 positioned on one side of a pair of stiffeners of an electrostatic precipitator, a portion of a second spacer assembly shown in dotted form positioned on the other side of the same pair of stiffeners, the two assemblies locked by a holding device of FIG. 22, and a third spacer assembly being attached to the first mentioned assembly by use of a second holding device, the holding device shown in the open position.
Figure 22:
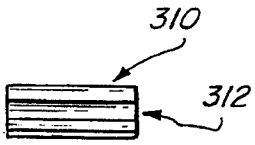
FIG. 22 is a bottom view of a holding device used with spacer assemblies shown in FIG. 21.
Figure 23:
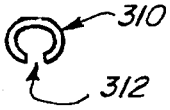
FIG. 23 is an end view of the holding device shown in FIG. 22.
Figure 21:
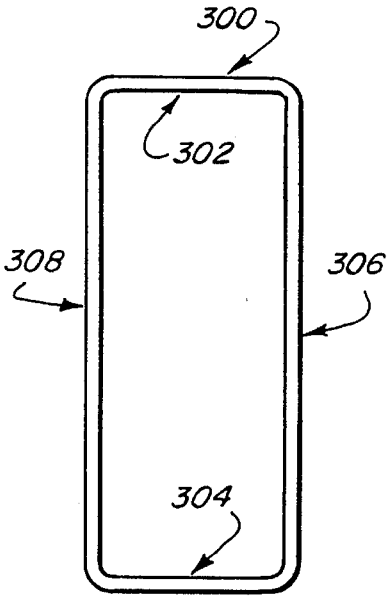
FIG. 21 is a front elevational view of a spacer assembly of a third form embodying the herein disclosed invention.

As may be seen in FIG. 24, spacer assembly 300 is loaded between a pair of adjacent plates on opposite sides of a pair of opposed stiffeners 234 and 236. A spacer assembly 320 which is identical to assembly 300, is shown on the far side of stiffeners 234 and 236. As viewed in FIG. 24, spacer assembly 300 has its uprights 306 and 308 on the other side of the stiffeners from that of spacer assembly 320, and is shown in supportive connection with assembly 320 by use of holding device 310, the gaps on said holding device having been narrowed. A third spacer assembly 340 identical in construction to assembly 300, is shown in position for receiving holding device 360, which is identical to holding device 310, to connect a spacer 304 of assembly 340 to spacer 302 of assembly 300. Holding device 360 is shown in an attitude to connect spacer assemblies 300 and 340.

The spacer assemblies are continually pulled down between the stiffeners while additional spacers are added from the top. It may be appreciated that the installation operation may be reversed, that is, the assembly may be pulled upward rather than downward. As is readily apparent, the spacer assembly can easily be constructed in other ways. For example, welding may be used in lieu of the holding device to secure the spacer assemblies in supportive engagement.

Although a specific embodiment of the herein disclosed invention has been shown and described in detail above, it is readily apparent that those skilled in the art may make various modifications and changes without departing from the spirit and scope of the present invention. It is to be expressly understood that the instant invention is limited only by the appended claims.

I claim:

1. In an electrostatic precipitator for collecting solid particles carried by a flue gas from a source of combustion, said precipitator including a plurality of spaced parallel plates for collecting solid particles by electrostatic attraction of said particles to the plates, said plates having a plurality of spatially arranged stiffeners projecting outwardly from opposite surfaces thereof, a plurality of elongated electrodes mounted between adjacent plates parallel to each other and parallel to the plates, the improvement comprising: a plurality of spacer assemblies positioned between adjacent plates to hold the plates in a flat attitude and to maintain adjacent surfaces of the adjacent plates equidistantly spaced from one another, each of said spacer assemblies including a spacer having opposite ends connected to opposed parallel plates at a pair of respective opposed stiffeners of the plates, an upright connected to the spacer, and a holding portion connected to the upright and being connectable to another spacer assembly adjacent to the same stiffeners to connect said spacer assemblies together and to hold said spacers parallel to each other and substantially perpendicular to the plates.

2. In an electrostatic precipitator for collecting solid particles carried by a flue gas from a source of combustion as defined in claim 1 including: a bail connected to one of said spacer assemblies being means for attachment of a device for pulling the spacer assemblies along the pair of opposed stiffeners of the respective pair of plates for positioning the spacer assemblies along the stiffeners.

3. In an electrostatic precipitator for collecting solid particles carried by a flue gas from a source of combustion as defined in claim 1 including: a top support connected to one of said spacer assemblies and to a portion of the precipitator for holding the spacer assemblies in a selected vertical attitude relative to said stiffeners.

4. In an electrostatic precipitator for collecting solid particles carried by a flue gas from a source of combustion as defined in claim 1, wherein each spacer assembly includes a complementary upright connected to its respective spacer and extending along the opposite stiffener, and a strut fixed to each pair of uprights of the spacer assembly holding the uprights spaced at a selected distance.

5. In an electrostatic precipitator for collecting solid particles carried by a flue gas from a source of combustion as defined in claim 1, wherein each spacer includes a bar, each bar has a stop on each end adapted for engagement with the respective plate, each spacer assembly includes a complementary upright having one end fixed to the respective spacer, each upright having an offset linking arm fixed to the respective spacer and being substantially perpendicular to the spacer, each upright having a taper post formed integral with the linking arm and being substantially perpendicular to the linking arm, each upright including an upright bar formed integral with each taper post, each pair of uprights of a spacer assembly having the taper posts and upright bars of the uprights positioned adjacent to the respective stiffeners, said linking arms being positioned between the stiffeners, and each spacer assembly includes a strut having opposite ends fixed to the upright bars of the uprights, each of said struts being adapted for engagement with the linking arms of an adjacent spacer assembly to lock releasably adjacent spacer assemblies together.

6. In an electrostatic precipitator for collecting solid particles carried by a flue gas from a source of combustion as defined in claim 1: including a bail connected to one of said spacer assemblies providing a means for attachment of a device for moving the spacer assemblies along the stiffeners, said bail including a pull, an upright, and a rung.

7. In an electrostatic precipitator for collecting solid particles carried by a flue gas from a source of combustion as defined in claim 1: including a bail connected to one of said spacer assemblies providing a means for attachment of a device for moving the spacer assemblies along the stiffeners, said bail including a pull, said pull including a pair of bars formed integrally with each other in the form of a "V", a shaft formed integral with the end of each bar and extending away from the "V", a crosstie fixed to the shafts adjacent to the bars, and a rung parallel to the crosstie and being fixed to the shafts, said rung being releasably connectable to the upright of one of said spacer assemblies for releasably connecting the bail to the one spacer assembly.

8. In an electrostatic precipitator for collecting solid particles carried by a flue gas from a source of combustion as defined in claim 1: including a top support for supporting the spacer assemblies along the stiffeners, said top support including a holding portion engageable with the precipitator, a second holding portion engageable with a spacer assembly, and an unright connecting the aforementioned holding portions.

9. In an electrostatic precipitator for collecting solid particles carried by a flue gas from a source of combustion as defined in claim 1: including a top support connected to one of the spacer assemblies and to the precipitator for supporting the spacer assemblies along the stiffeners, said top support including a pair of hooks engageable with the precipitator, each of said hooks being spaced from the other and being substantially parallel to the other, a shank formed integral with each of the hooks, an offset arm formed integral with each shank, and a connector formed integral with the offset arms, whereby a portion of the spacer assembly is positioned between the hooks and in engagement with the connector.

10. In an electrostatic precipitator for collecting solid particles carried by a flue gas from a source of combustion as defined in claim 1, wherein each spacer assembly includes a complementary upright connected to its respective spacer and extending along the respective stiffener, and a strut fixed to each pair of uprights of the spacer assembly holding the uprights spaced at a selected distance, and including a bail connected to one of said spacer assemblies being means for attachment of a device for pulling the spacer assemblies along the pair of opposed stiffeners of the respective pair of plates for positioning the spacer assemblies along the stiffeners.

11. In an electrostatic precipitator for collecting solid particles carried by a flue gas from a source of combustion as defined in claim 1, including: a top support connected to one of said spacer assemblies and to a portion of the precipitator for holding the spacer assemblies in a selected vertical attitude relative to said stiffeners, and a bail connected to another one of said spacer assemblies being means for attachment of a device for pulling the spacer assemblies along the pair of opposed stiffeners for positioning the spacer assemblies along the stiffeners.

12. In an electrostatic precipitator for collecting solid particles carried by a flue gas from a source of combustion as defined in claim 1, wherein each spacer assembly includes a complementary upright connected to its respective spacer and extending along the other opposed stiffener, and a strut fixed to each pair of uprights of the spacer assembly holding the uprights spaced at a selected distance, and including; a bail connected to one of said spacer assemblies being means for attachment of a device for pulling the spacer assemblies along the pair of opposed stiffeners for positioning the spacer assemblies along the stiffeners, and a top support connected to another one of said spacer assemblies and to a portion of the precipitator for holding the spacer assemblies in a selected vertical attitude relative to said stiffeners.

13. In an electrostatic precipitator for collecting solid particles carried by a flue gas from a source of combustion as defined in claim 1 including: a bail connected to one of said spacer assemblies being means for attachment of a device for moving the spacer assemblies along the stiffeners, said bail including a pull, said pull including a pair of bars formed integral with each other in the form of a "V", a shaft formed integral with the end of each bar extending away from the "V", a crosstie fixed to the shafts adjacent to the bars, and a rung parallel to the crosstie and being fixed to the shafts, said rung being releasably connectable to the upright of one of said spacer assemblies for releasably connecting the bail to the spacer assembly, and a top support connected to another of the spacer assemblies and to the precipitator for supporting the spacer assemblies along the stiffeners, said top support including a pair of hooks engageable with the precipitator, each of said hooks being spaced from the other and being substantially parallel from the other, a shank formed integral with each of the hooks, an offset arm formed integral with each shank, and a connector formed integral with the offset arms, whereby a portion of the other spacer assembly is positioned between the hooks and is engageable with the connector to be supported by the top support and to hold the spacer assemblies relative to the stiffeners.

14. In an electrostatic precipitator for collecting solid particles carried by a flue gas from a source of combustion as defined in claim 1, wherein each spacer includes a bar, each bar has a stop on each end adapted for engagement with the respective plate, each spacer assembly includes a complementary upright having one end fixed to the respective spacer, each upright having an offset linking arm fixed to the respective spacer and being substantially perpendicular to the spacer, each upright having a taper post formed integral with the linking arm and being substantially perpendicular to the linking arm, each upright including an upright bar formed integral with each taper post, each pair of uprights of a spacer assembly having their taper posts and upright bars of the uprights positioned adjacent to the respective stiffeners, said linking arms being positioned between the stiffeners, and each spacer assembly includes a strut having opposite ends fixed to the upright bars of the uprights, each of said struts being engageable with the linking arms of an adjacent spacer assembly to lock releasably adjacent spacer assemblies together, and a bail connected to one of said spacer assemblies being means for attachment of a device for moving the spacer assemblies along the stiffeners, said bail including a pull, said pull including a pair of bars formed integral with each other in the form of a "V" and a shaft formed integral with the end of each bar and extending away from the "V", a crosstie fixed to the shafts adjacent to the bars, and a rung parallel to the crosstie and being fixed to the shafts, said rung being releasably connectable with the linking arms of one of said spacer assemblies releasably connecting the bail to the spacer assembly.

15. In an electrostatic precipitator for collecting solid particles carried by a flue gas from a source of combustion as defined in claim 1, wherein each spacer includes a bar, each bar has a stop on each end adapted for engagement with the respective plate, each spacer assembly includes a complementary upright having one end fixed to the respective spacer and extending away from the spacer in the same direction as the first mentioned upright, each upright having an offset linking arm fixed to the respective spacer and being substantially perpendicular to the spacer, each upright having a taper post formed integral with the linking arm and being substantially perpendicular to the linking arm, each upright including an upright bar formed integral with the taper post, each pair of uprights of a spacer assembly having the taper posts and upright bars of the uprights positioned adjacent to the respective stiffener, said linking arms being positioned between the stiffeners, and each spacer assembly includes a strut having opposite ends fixed to the upright bars of the uprights, each of said struts being engageable with the linking arms of an adjacent spacer assembly to lock releasably adjacent spacer assemblies together, and a top support connected to another of the spacer assemblies and to the precipitator supporting the spacer assemblies along the stiffeners, said top support including a pair of hooks engageable with the precipitator, each of said hooks being spaced from the other and being substantially parallel to the other, a shank formed integral with each of the hooks, an offset arm formed integral with each shank, and a connector formed integral with the offset arms, whereby the connector is positioned in engagement with the strut of the other spacer assembly and the hooks are positioned in engagement with the precipitator to hold the spacer assemblies along the stiffeners.

16. In an electrostatic precipitator for collecting solid particles carried by a flue gas from a source of combustion as defined in claim 1, wherein each spacer includes a bar adapted to be positioned in a substantially horizontal attitude between the adjacent plates and substantially perpendicular to the plates, each bar being substantially parallel to each other bar, each bar has a stop on each end thereof adapted for engagement with the respective plate, each spacer assembly includes a complementary upright having one end fixed to the respective spacer and extending outward from the spacer in the same direction as the first mentioned upright, each upright in each spacer assembly having a linking arm fixed to the respective spacer and being substantially perpendicular to the spacer, each upright having a taper post formed integral with each linking arm and being substantially perpendicular to the linking arm, said taper posts of each spacer assembly being closer together at the spacer and spreading apart away from the spacer, each upright including an upright bar formed integral with each taper post, each pair of upright bars in each spacer assembly being substantially parallel to each other, each pair of uprights of each spacer assembly having the taper posts and upright bars positioned adjacent to the respective stiffeners, said linking arms being positioned between the respective stiffeners, and each spacer assembly includes a strut having opposite ends fixed to the upright bars of the uprights, each of said struts being adapted for engagement with the linking arms of an adjacent spacer assembly to lock releasably to each other adjacent spacer assemblies, a bail connected to the lowermost of said spacer assemblies being means for attachment of a device for moving the spacer assemblies along the stiffeners, said bail including a pull, said pull including a pair of bars formed integrally with one another in the form of a "V", a shaft formed integral with the end of each bar extending away from the "V", a crosstie fixed to the shafts adjacent to the bars, and a rung parallel to the crosstie fixed to the shafts, said rung being releasably connectable to the linking arms of the lowermost spacer assembly for releasably connecting the bail to the lowermost spacer assembly, and a top support connected to the uppermost of the spacer assemblies and to the precipitator for supporting the spacer assemblies along the stiffeners, said top support including a pair of hooks engageable with the precipitator, each of said hooks being spaced from the other and being substantially parallel to the other, a shank formed integral with each hook, an offset arm formed integral with each shank, and a connector formed integral with the offset arms and being perpendicular to the offset arms, thereby the strut of the uppermost spacer assembly is positioned between the hooks and is engageable with the connector while the hooks are in engagement with the precipitator to hold the spacer assemblies in a selected position along the stiffeners.

17. A spacer assembly for use in an electrostatic precipitator for holding adjacent plates of the precipitator a selected distance apart comprising; a spacer adapted for having its opposed ends in engagement with adjacent plates of a precipitator, an upright connected to said spacer, and a holding portion connected to the upright adapted for connection to another spacer assembly.

18. A spacer assembly for use in an electrostatic precipitator for holding adjacent plates of the precipiator a selected distance apart as defined in claim 17: including a linking arm offset from the upright to allow one portion of the spacer assembly to be positioned on one side of a pair of opposed stiffeners on respective plates and the remainder of the spacer assembly on the other side of the stiffeners.

19. A spacer assembly for use in an electrostatic precipitator for holding adjacent plates of the precipitator a selected distance apart as defined in claim 17 including: a second upright having one end connected to said spacer and the other end connected to the holding portion, and an offset between each of the uprights and the holding portion to position the holding portion a selected distance from the uprights for holding another spacer assembly a selected distance from the spacer assembly to allow a stiffener of a plate to be positioned between the spacer assemblies.

20. A spacer assembly for use in an electrostatic precipitator for holding adjacent plates of the precipitator a selected distance apart as defined in claim 17 including: a second upright having one end formed integral with one end of the spacer and the other end connected to the holding portion, said holding portion including a cross bar for holding the uprights substantially parallel to each other.

21. A spacer assembly for use in an electrostatic precipitator for holding adjacent plates of the precipitator a selected distance apart as defined in claim 17 including: a second upright having one end formed integral with one end of the spacer and the other end connected to the holding portion, a pair of parallel bars, each parallel bar connected to the end of one of said uprights connected to the holding portion, a column formed integral with each of the parallel bars, and an offset formed integral with each of the columns for holding the holding portion a selected distance from a plane defined by the spacer and the uprights.

22. A spacer assembly for use in an electrostatic precipitator for holding adjacent plates of the precipitator a selected distance apart as defined in claim 17 including: a second upright connected to said spacer, each of said uprights including a linking arm offsetting the remainder of the upright from the spacer to allow the spacer to be positioned on one side of a pair of opposed stiffeners on respective plates and the remainder of the upright on the other side of the stiffeners, and a strut positioned between the end of the uprights spaced away from the spacer.

23. A spacer assembly for use in an electrostatic precipitator for holding adjacent plates of the precipitator a selected distance apart as defined in claim 22, wherein each of the uprights includes a taper post, each taper post has one end formed integral with the respective linking arm, said taper posts being positioned closer together at the linking arms than the length of the strut positioned between the uprights.

24. A spacer assembly for use in an electrostatic precipitator for holding adjacent plates of the precipitator a selected distance apart as defined in claim 22, wherein the spacer includes a horizontal bar having stops on opposite ends adapted for engagement with opposed plates of an electrostatic precipitator.

25. A spacer assembly for use in an electrostatic precipitator for holding adjacent plates of the precipitator a selected distance apart as defined in claim 22, wherein the spacer includes a horizontal bar having stops formed integral with opposite ends of the bar, said stops being adapted for engagement with opposed plates of an electrostatic precipitator, the linking arms of each of the uprights being fixed to the bar of the spacer between the stops, each of said uprights including a taper post formed integral with each linking arm, said taper posts being positioned closer adjacent to the spacer than away from the spacer, said stops and the bar of the spacer defining a plane, said taper posts of the uprights defining a second plane being substantially parallel to the first mentioned plane, said planes being spaced apart a greater distance than the thickness of the strut and stiffeners.

26. A spacer assembly for use in an electrostatic precipitator for holding adjacent plates of the precipitator a selected distance apart as defined in claim 22, wherein the spacer includes a bar having stops formed integral with each end thereof, each of said stops being adapted for engagement with an opposed plate of an electrostatic precipitator, each of said linking arms being connected to the bar of the spacer, each of said uprights including a taper post having one end formed integral with its respective linking arm, said taper posts being closer together at the linking arms than away from the linking arms, an upright bar formed integral with the outermost end of each taper post, said upright bars being parallel to each other and having the strut positioned between the upright bars, the distance between the upright bars being sufficient to receive the linking arms of a like spacer assembly between the upright bars and in engagement with the strut for interlocking a pair of adjacent spacer assemblies.

27. A spacer assembly for use in an electrostatic precipitator for holding adjacent plates of the precipitator a selected distance apart comprising: a spacer adapted for having its opposed ends in engagement with adjacent plates of a precipitator, an upright connected to said spacer, and a holding device connected to the spacer and being adapted to connect two spacer assemblies together.

28. A spacer assembly for use in an electrostatic precipitator for holding adjacent plates of the precipitator a selected distance apart as defined in claim 27, wherein two spacer assemblies are connected by the holding device, wherein said holding device is locked by means of crimping.

29. A spacer assembly for use in an electrostatic precipitator for holding adjacent plates of the precipitator a selected distance apart comprising: a spacer adapted for having its opposed ends connected to adjacent plates of a precipitator, and an upright connected to said spacer, wherein two spacer assemblies are connected together by means of welding.

30. In an electrostatic precipitator having adjacent first and second curtains, the improvement comprising a spacer inserted between said first and second curtains to effect straightening of said curtains when warped and, thereafter, to prevent further curtain warpage, each curtain having a top edge and being disposed substantially parallel with the adjacent curtain, said spacer comprising:

(a) a hanger comprising first suspending means secured at one end to engage and to suspend said hanger from the top edge of the first curtain, and second suspending means spaced from said first suspending means; and (b) at least one hanging member having third suspending means for engaging said second suspending means and suspending said hanging member from and below said hanger, and first and second guide means for engaging respectively the first and second curtains to orient said hanging member substantially perpendicular to each of the first and second curtains and to facilitate relatively free movement between the first and second guide means and the first and second curtains.

31. The precipitator as claimed in claim 30, wherein each said curtain has at least one stiffening member extending therefrom, wherein said first and second guide means engage said stiffening members.

32. The precipitator as claimed in claim 30, wherein there is included a plurality of said hanging members vertically aligned.

33. The precipitator as claimed in claim 30, wherein said hanging member comprises a first vertically oriented portion extending along the first curtain, and a second vertically oriented portion extending along the second curtain, and means disposed between and interconnecting said first and second vertical portions, whereby the first and second curtains are spaced apart a given distance.

34. The precipitator as claimed in claim 33, wherein said first and second guide means are affixed to said first and second vertical portions, respectively.

35. A method of installing a spacer between adjacent first and second curtains of an electrostatic precipitator to effect a gradual straightening of any warpage therein, the spacer comprising a hanger with first suspending means secured to one end to engage and to suspend the hanger from a top edge of the first curtain and second suspending means spaced from said first suspending means, and a selected number of vertically aligned hanging members, each hanging member having spaced apart third and fourth suspending means, said third suspending means engaging said second suspending means of said hanger or said fourth suspending means of that hanging member disposed immediately above and suspending said hanging member from below the hanger or the above hanging member, said method comprising the steps of:

(a) placing the first of the selected number of hanging members between the first and second curtains and disposing the first hanging member downwardly; and (b) connecting the third suspending means of the first hanging member to the fourth suspending means of the next above hanging member and, thereafter, disposing the first and second hanging members downward together.

36. The method as claimed in claimed 35, further including the repeating of steps (a) and (b) until a sufficient number of hanging members have been inserted between the first and second curtain to straighten any warpage therein.

37. The method as claimed in claim 36, further including the step of suspending said hanger at one end to engage and to suspend the hanger from the top of the first curtain and connecting the second suspending means of the hanger with the third suspending means of the hanging member disposed immediately there below.

* * * * *